US007513226B2

(12) United States Patent
Swain et al.

(10) Patent No.: US 7,513,226 B2
(45) Date of Patent: Apr. 7, 2009

(54) HYDRAULIC CONTROL SYSTEM FOR A SWITCHING VALVE TRAIN

(75) Inventors: Jeff L. Swain, Flushing, MI (US); Craig D. Marriott, Clawson, MI (US); Timothy L. Neal, Ortonville, MI (US); Joseph J. Moon, Clawson, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/756,847

(22) Filed: Jun. 1, 2007

(65) Prior Publication Data

US 2008/0295787 A1 Dec. 4, 2008

(51) Int. Cl.
*F01L 9/02* (2006.01)

(52) U.S. Cl. ..... 123/90.12; 123/90.17; 123/90.27; 123/193.5; 123/195 C; 464/160

(58) Field of Classification Search ..... 123/90.12, 123/90.13, 90.16, 90.27, 90.31, 90.15, 90.17, 123/90.38, 193.3, 193.5, 195 C, 196 M, 198 F; 464/1, 2, 160
See application file for complete search history.

(56) References Cited

U.S. PATENT DOCUMENTS

RE35,382 E * 11/1996 Saito ..... 123/90.27
7,162,986 B2 1/2007 Yoshijima et al.
7,255,078 B2 * 8/2007 Yoshijima et al. ..... 123/90.38

* cited by examiner

*Primary Examiner*—Ching Chang

(57) ABSTRACT

An engine is provided having an engine block, a cylinder head mounted to the engine block, a valve train mounted to the cylinder head, and a cam cover extending over the valve train and mounted to the cylinder head. A hydraulic system for providing a hydraulic fluid to the valve train is included. The hydraulic system has a first passage extending from the engine block through the cylinder head to the cam cover and connected to a second passage. The second passage extends along a length of the cam cover and is connected to an oil control valve. At least one control passage extends from the oil control valve through the cam cover to the valve train. The oil control valve is mounted to a port in the cam cover and extends into the cam cover in a direction along a width of the cam cover.

14 Claims, 2 Drawing Sheets

HYDRAULIC CONTROL SYSTEM FOR A SWITCHING VALVE TRAIN

FIELD

The present disclosure relates to hydraulic systems, and more particularly to a hydraulic control assembly for a switching valve train.

BACKGROUND

The statements in this section merely provide background information related to the present disclosure and may or may not constitute prior art.

Switching valve train systems are a recent innovation used with internal combustion engines. A typical switching valve train system includes a rocker assembly that selectively engages an exhaust or intake valve. The rocker assembly is preferably operated in several modes. Each mode is activated by hydraulically actuating the rocker assembly.

An oil control valve, or OCV, is preferably used to selectively provide hydraulic fluid to the rocker assembly of the switching valve train system. Locating one or more OCV's within the combustion engine can be problematic as the OCV's require oil control galleries or passages to feed the OCV with hydraulic fluid, such as oil, and to then route the hydraulic fluid to the switching valve train system and then on to a sump in the engine block.

Accordingly, there is room in the art for a hydraulic control assembly that provides an arrangement of OCV's and oil control galleries in the combustion engine that requires a minimum of machining and does not significantly disturb preexisting components within the engine block, cylinder head, and cam cover.

SUMMARY

The present invention provides an engine having an engine block, a cylinder head mounted to the engine block, a valve train mounted to the cylinder head, and a cam cover extending over the valve train and mounted to the cylinder head. A hydraulic system for providing a hydraulic fluid to the valve train is included. The hydraulic system has a first passage extending from the engine block through the cylinder head to the cam cover and connected to a second passage. The second passage extends along a length of the cam cover and is connected to an oil control valve. At least one control passage extends from the oil control valve through the cam cover to the valve train. The oil control valve is mounted to a port in the cam cover and extends into the cam cover in a direction along a width and a height of the cam cover.

In a first aspect of the present invention, the port is located on an outer surface of the cam cover.

In another aspect of the present invention, the first passage and the second passage are integrally formed in the cam cover between a smooth inner surface and a smooth outer surface.

In still another aspect of the present invention, the oil control valve extends along the width in a direction outward from a center of the engine.

In still another aspect of the present invention, the second passage is horizontal.

In still another aspect of the present invention, the engine further includes a second oil control valve mounted to a second port in the cam cover, the second oil control valve aligned with the first oil control valve and spaced from the first oil control valve along the length of the cam cover.

In still another aspect of the present invention, the first passage connects to the second passage between the first oil control valve and the second oil control valve.

In still another aspect of the present invention, the valve train includes a hydraulic lash adjuster, and the control passage connects with the hydraulic lash adjuster to provide the hydraulic fluid to the valve train.

In still another aspect of the present invention, the engine further includes a second control passage extending from the oil control valve to an interface between the cam cover and the cylinder head.

In still another aspect of the present invention, the engine further includes a third control passage connected to the second control passage and extending to a first hydraulic lash adjuster in the valve train.

In still another aspect of the present invention, the engine further includes a second valve train having a second lash adjuster, and the hydraulic system includes a third control passage connected between the second control passage and the second hydraulic lash adjuster.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
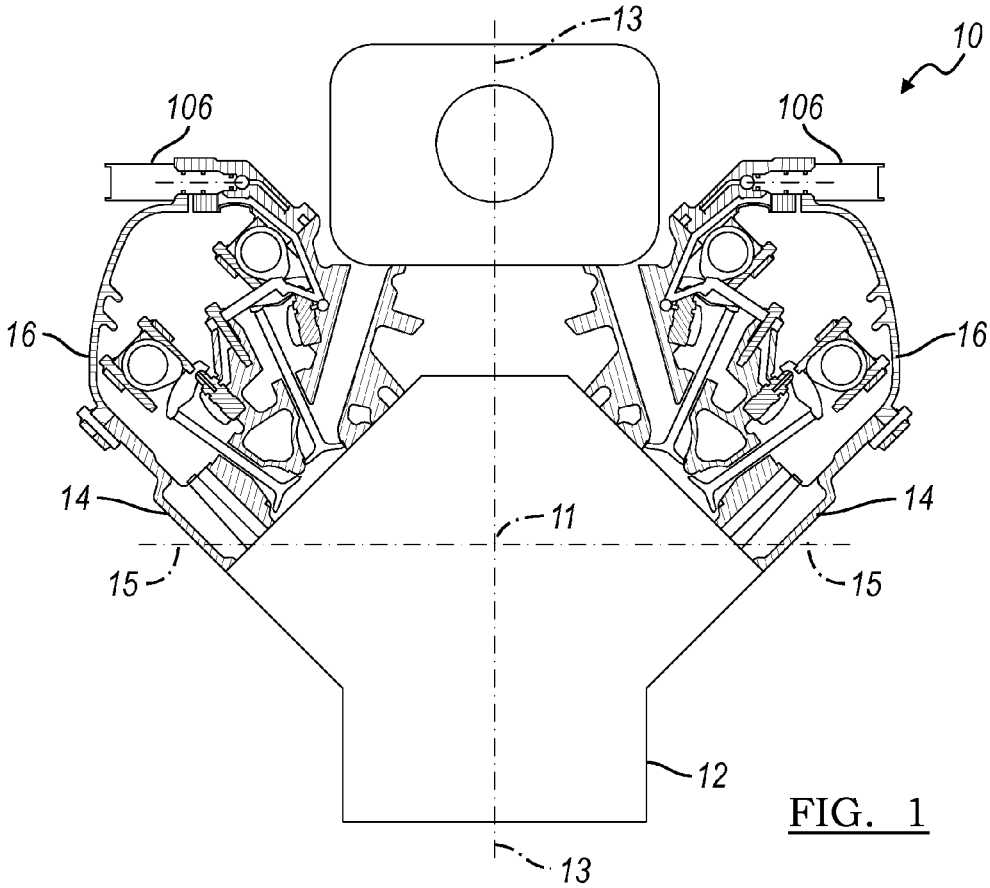
FIG. 1 is a schematic end view of an exemplary internal combustion engine having a cam cover and hydraulic control system according to the principles of the present invention.

With reference to FIG. 1, a schematic diagram of an exemplary internal combustion engine is indicated by reference number 10. The engine 10 includes a switching valve train system, as will be described in greater detail below, used to variably actuate a plurality of intake and exhaust valves. While the engine is illustrated as a "V"-type engine, it should be appreciated that the engine 10 may take various forms, including an inline engine, without departing from the scope of the present invention. The engine 10 defines a horizontal or longitudinal axis, indicated by reference number 11, along the length of the engine 10, a vertical axis, indicated by reference number 13, along the height of the engine 10, and a span axis, indicated by reference number 15, along the width of the engine 10. The engine 10 generally includes an engine block 12, a cylinder head 14, and at least one valve or cam cover 16. The engine block 12 houses a plurality of engine components including a plurality of combustion cylinders (not shown). The cylinder head 14 is located over top the engine block 12 and caps the combustion cylinders, as well as houses the intake and exhaust valves of a typical internal combustion engine. The cam cover 16 fits over top at least a portion of the cylinder head 14 and protects any engine components underneath the cam cover 16 from outside interference or damage.

Figure 2:
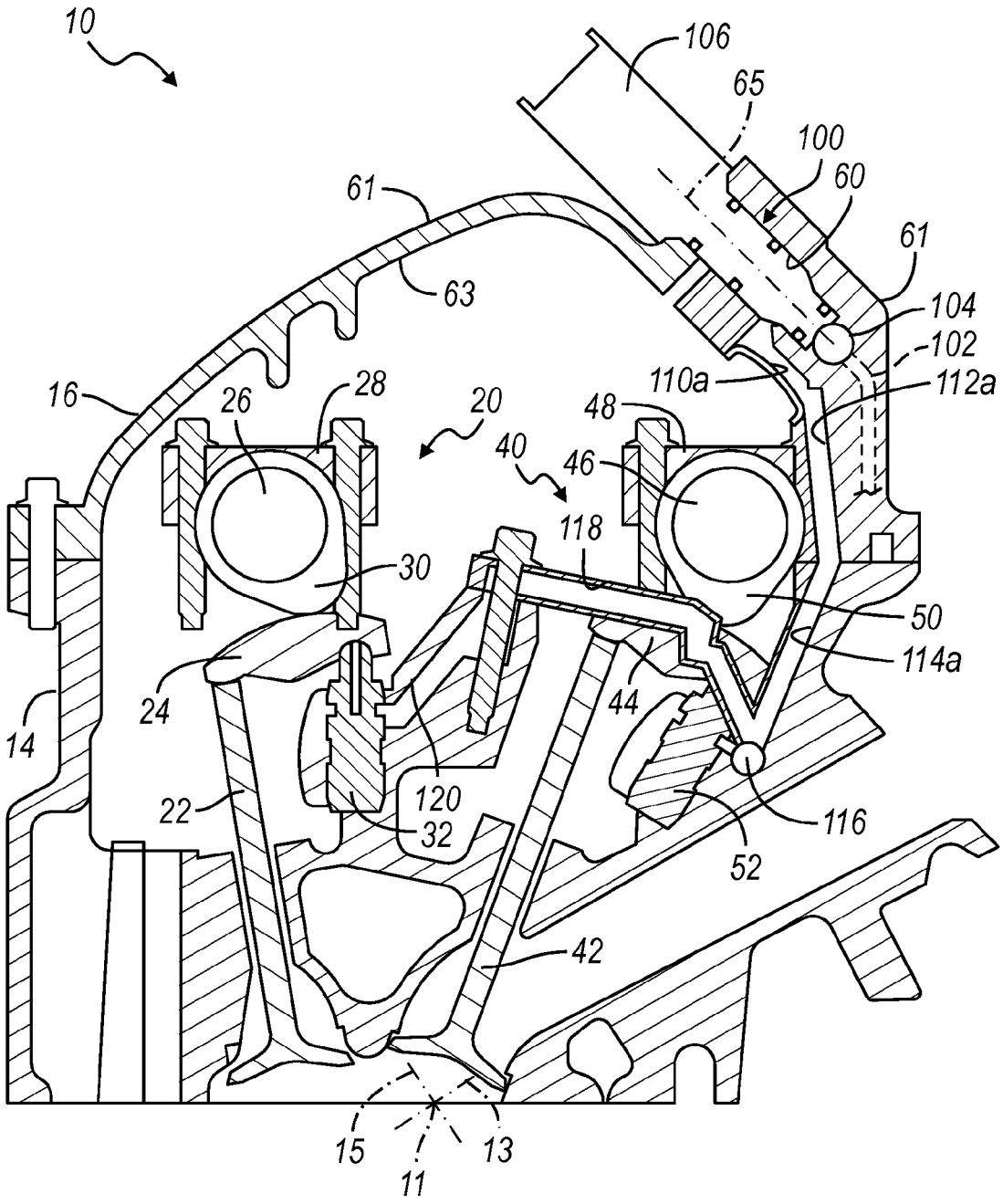
FIG. 2 is a side view of a portion of the exemplary internal combustion engine and of the hydraulic control system of the present invention.

With reference to FIG. 2, a cross-sectional portion of the engine 10 is illustrated. The engine 10 includes an exhaust switching valve train system, indicated by reference number 20, mounted to the cylinder head 14. The valve train 20 generally includes an exhaust valve 22, a rocker arm assembly 24, and a camshaft 26. The exhaust valve 22 extends through the cylinder head 14 and into one of the cylinders (not shown) of the engine 10 within the engine block 12. The exhaust valve 22 is operable to selectively open, vary the opening height, and close to allow exhaust to exit the cylinder.

The camshaft 26 is mounted to the cylinder head 14 by a cam cap 28. The camshaft 26 includes a plurality of cams 30, only one of which is shown. The rocker arm assembly 24 is located beneath the camshaft 26 and is coupled to the exhaust valve 22 at one end and coupled to the cylinder head 14 at an opposite end by a hydraulic lash adjuster 32. The camshaft 26 is operable to engage the rocker arm assembly 24 to selectively open, vary the opening height, and close the exhaust valve 22.

The engine 10 also includes an intake switching valve train system, indicated by reference number 40, mounted to the cylinder head 14. The valve train 40 generally includes an intake valve 42, a rocker arm assembly 44, and a camshaft 46. The intake valve 42 extends through the cylinder head 14 and into one of the cylinders (not shown) of the engine 10 within the engine block 12. The intake valve 42 is operable to selectively open, vary the opening height, and close to allow intake air to enter the cylinder.

The camshaft 46 is mounted to the cylinder head 14 by a cam cap 48. The camshaft 46 includes a plurality of cams 50, only one of which is shown. The rocker arm assembly 44 is located beneath the camshaft 46 and is coupled to the intake valve 42 at one end and coupled to the cylinder head 14 at an opposite end by a hydraulic lash adjuster 52. The camshaft 46 is operable to engage the rocker arm assembly 44 to selectively open, vary the opening height, and close the intake valve 42. While only a single intake valve 42 and exhaust valve 22 are shown, it should be appreciated that any number of intake valves and exhaust valves with corresponding valve trains may be employed without departing from the scope of the present invention.

Figure 3:
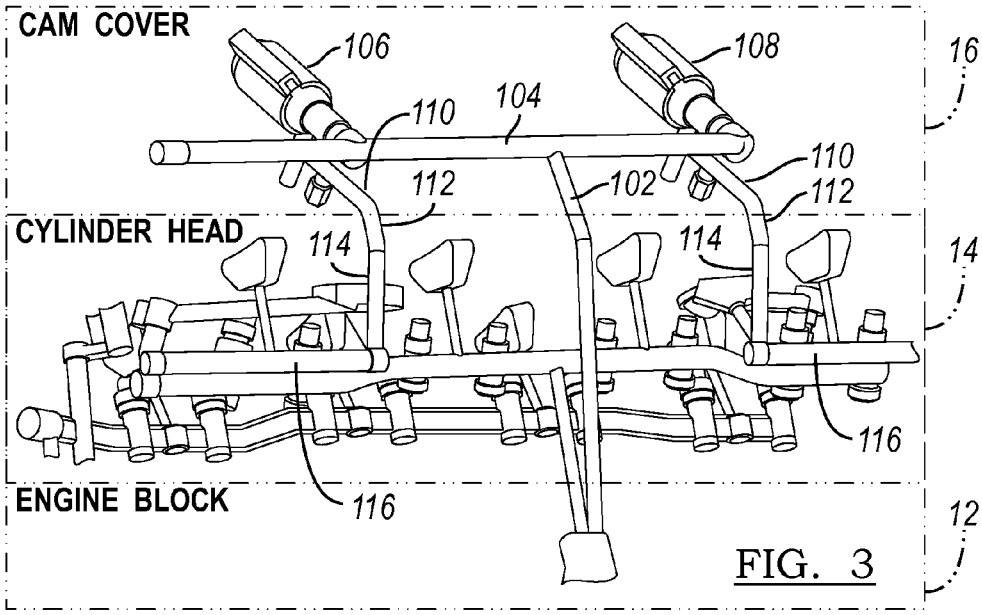
FIG. 3 is an isometric schematic diagram of the hydraulic control system of the present invention.

With combined reference to FIGS. 2 and 3, the engine 10 further includes a hydraulic control system, generally indicated by reference number 100. The hydraulic control system 100 is operable to transport a pressurized hydraulic fluid, such as oil, from a fluid source (not shown) through the engine 10 to various components, including the valve trains 20 and 40. The hydraulic control system 100 includes a supply gallery or passage 102. The supply passage 102 extends from the engine block 12 through the cylinder head 14 and into the cam cover 16. The supply passage 102 is connected to an oil supply (not shown) in the engine block 12 and connected at an opposite end to a main oil gallery or passage 104 in the cam cover. The main oil passage 104 is formed integrally into the cam cover 16 and extends generally horizontally parallel to reference line 11 (FIG. 1) along the length of the cam cover 16. The main oil passage 104 is located between a smooth outer surface 61 of the cam cover and a smooth inner surface 63 of the cam cover.

A first oil control valve (OCV) 106 and a second oil control valve (OCV) 108 are connected to the main oil passage 104. While two OCV's 106, 108 are shown in the example provided, it should be appreciated that any number of OCV's 106, 108 may be employed without departing from the scope of the present invention. The OCV's 106, 108 are in electronic communication with a controller (not shown). The OCV's 106, 108 are employed to control the amount or pressure of the hydraulic fluid or oil passing through the OCV's 106, 108 from the main oil passage 104 according to signals sent from the controller, as will be described in greater detail below.

Each OCV 106, 108 is mounted to the cam cover 16. More specifically, the cam cover 16 includes a pair of mounting ports 60 formed on the outer surface 61 of the cam cover 16. The mounting ports 60 are sized to receive at least a portion of the OCV's 106, 108 therein. The OCV's 106, 108 and the mounting ports 60 each define a common longitudinal axis, indicated by reference number 65. The axes 65 of the OCV's 106, 108 are oriented such that they extend into the cam cover 16 in a direction outwards from a center of the engine 10 along the span axis 15 perpendicular to the vertical axis 13. In an alternate embodiment, the OCV's 106, 108 may also extend downwards from a top of the engine 10 along the vertical axis 13. In other words, the axes 65 of the OCV's 106, 108 are oriented in the alternate embodiment such that they are perpendicular to a reference line parallel to the longitudinal axis 11 and at an angle with respect to the vertical axis 13 and the span axis 15. As best seen in FIG. 3, the OCV's 106, 108 are spaced apart along the length of cam cover 16 and the main oil passage 104 such that the supply passage 102 connects to the main oil passage 104 at a location between the OCV 106 and the OCV 108.

The hydraulic control system 100 further includes a plurality of control galleries or passages located within the cam cover 16 and cylinder head 14 to route the hydraulic fluid from the OCV's 106, 108 to respective valve trains 20, 40. In the particular example provided, each OCV 106, 108 is operable to control the hydraulic fluid pressure to a set of intake and exhaust valve trains. Accordingly, the OCV 106 controls the pressurized fluid to both the intake valve train 20 and the exhaust valve train 40 illustrated in the example provided. However, it should be appreciated that separate OCV's may be used to control separate intake and exhaust valves without departing from the scope of the present invention. More specifically, a first control gallery or passage 110 is connected to the first OCV 106. The first control passage 110 receives the regulated pressurized fluid from the OCV 106. The first control passage 110 is formed integrally with the cam cover 16 between the inner surface 63 and the outer surface 61 and runs approximately parallel to the longitudinal axis 65 of the OCV 106. The first control passage 110 is connected at an end thereof to a second control passage 112. The second control passage 112 is also formed integrally with the cam cover 16 between the inner surface 63 and the outer surface 61 and runs at an angle with respect to the vertical axis 13. Both the first passage 110 and the second passage 112 approximately follow the contour of the outer surface 61 and the inner surface 63 of the cam cover 16. Additionally, both the first passage 110 and the second passage 112 can be considered a single passage integrally formed with the cam cover 16 without departing from the scope of the present invention.

The second control passage 112 connects with a third control passage 114. The third control passage 114 is formed integrally with the cylinder head 14. The connection between the second control passage 112 and the third control passage 114 corresponds to the interface between the cam cover 16 and the cylinder head 14. The third control passage 114 extends at an angle with respect to the second control passage 1 12 and the vertical axis 13 and connects to a second supply gallery or passage 116.

The second supply passage 116 is integrally formed with the cylinder head 14 and extends approximately parallel to the longitudinal axis 11 along the length of the cylinder head 14. The second supply passage 116 connects with the hydraulic lash adjuster 52 of the intake valve train 40. Accordingly, pressurized hydraulic fluid is provided to the OCV 106 through the supply passage 102 and the main supply passage 104 from a pressurized hydraulic fluid source (not shown). The OCV 106 is then controlled to selectively regulate the pressure of the hydraulic fluid therethrough. The regulated hydraulic fluid from the OCV 106 is channeled through the control passages 110, 112, 114, and 116 to the hydraulic lash adjuster 52, thereby providing regulated hydraulic fluid to the intake valve train 40.

A fourth control gallery or passage 118 is connected to the second supply passage 116 and extends towards the valve train 20. A fifth control gallery or passage 120 is connected to the fourth control passage 118. The fifth control passage 120 connects with the hydraulic lash adjuster 32 in the exhaust valve train 20. Accordingly, regulated hydraulic fluid from the OCV 106 is channeled through the control passages 110, 112, 114, 116,118, and 120 to the hydraulic lash adjuster 32, thereby providing regulated hydraulic fluid to the exhaust valve train 20. Additionally, it should be appreciated that the third passage 114, the second supply passage 116, the fourth passage 118, and the fifth passage 120 can be considered a single passage integrally formed in the cylinder head 14 without departing from the scope of the present invention.

The control passages connected to the second OCV 108 are substantially similar to the control passages connected to the first OCV 106 and include passages 110, 112 integrally formed in the cam cover 16 and passages 114, 116, 118, and 120 integrally formed in the cylinder head 14. Additionally, while in the particular example provided the hydraulic control system 100 is connected to both the intake and exhaust valve trains 40, 20, it should be appreciated that only one of either the intake valve train 40 or the exhaust valve train 20 may be coupled to the hydraulic control system 100 without departing from the scope of the present invention.

The description of the invention is merely exemplary in nature and variations that do not depart from the gist of the invention are intended to be within the scope of the invention. Such variations are not to be regarded as a departure from the spirit and scope of the invention.

What is claimed is:

1. An engine comprising:

an engine block;

a cylinder head mounted to the engine block;

a valve train mounted to the cylinder head;

a cam cover extending over the valve train and mounted to the cylinder head, the cam cover having a first wall and a pair of substantially opposing side walls; and a hydraulic system for providing a hydraulic fluid to the valve train, the hydraulic system having a first passage extending from the engine block through the cylinder head to the cam cover and at least partially disposed within one of the pair of substantially opposing side walls of the cam cover and wherein the first passage is connected to a second passage, the second passage extending along a length of the cam cover and connected to an oil control valve, and at least one control passage extending from the oil control valve through the cam cover and the cylinder head to the valve train.

2. The engine of claim 1 wherein the oil control valve is mounted to a port in the cam cover and extends into the cam cover in a direction along a width of the cam cover.

3. The engine of claim 2 wherein the port is located on an outer surface of the cam cover.

4. The engine of claim 3 wherein a portion of the first passage disposed in the cam cover and the second passage are integrally formed in one of the pair of substantially opposing side walls of the cam cover between a smooth inner surface and a smooth outer surface.

5. The engine of claim 4 wherein the oil control valve extends along the width in a direction outward from a center of the engine and extends along the height in a direction downward from a top of the engine.

6. The engine of claim 5 wherein the second passage is horizontal.

7. The engine of claim 1 further comprising a second oil control valve mounted to a second port in the cam cover, the second oil control valve aligned with the first oil control valve and spaced from the first oil control valve along the length of the cam cover.

8. The engine of claim 7 wherein the first passage connects to the second passage between the first oil control valve and the second oil control valve.

9. The engine of claim 1 wherein the valve train includes a hydraulic lash adjuster, and the control passage connects with the hydraulic lash adjuster to provide the hydraulic fluid to the valve train.

10. The engine of claim 1 further comprising a second control passage extending from the oil control valve to an interface between the cam cover and the cylinder head.

11. The engine of claim 10 wherein a third control passage is disposed in a side wail of the cylinder head.

12. The engine of claim 10 further comprising a third control passage connected to the second control passage and extending to a first hydraulic lash adjuster in the valve train.

13. The engine of claim 12 further comprising a second valve train having a second lash adjuster, and the hydraulic system includes a third control passage connected between the second control passage and the second hydraulic lash adjuster.

14. The engine of claim 1 wherein the oil control valve is at least partially disposed within the first wall of the cam cover.

* * * * *